US011294309B2

(12) United States Patent
Mayer et al.

(10) Patent No.: US 11,294,309 B2
(45) Date of Patent: Apr. 5, 2022

(54) FIRST PAGE OUT REDUCTION

(71) Applicant: Hewlett-Packard Development Company, L.P., Spring, TX (US)

(72) Inventors: Brian C Mayer, Boise, ID (US); Quintin Phillips

(73) Assignee: Hewlett-Packard Development Company, L.P., Spring, TX (US)

( * ) Notice: Subject to any disclaimer, the term of this patent is extended or adjusted under 35 U.S.C. 154(b) by 585 days.

(21) Appl. No.: 16/317,890

(22) PCT Filed: Jul. 15, 2016

(86) PCT No.: PCT/US2016/042607
§ 371 (c)(1),
(2) Date: Jan. 15, 2019

(87) PCT Pub. No.: WO2018/013140
PCT Pub. Date: Jan. 18, 2018

(65) Prior Publication Data

US 2021/0286299 A1 Sep. 16, 2021

(51) Int. Cl.
*G03G 15/20* (2006.01)
*G03G 15/00* (2006.01)

(52) U.S. Cl.
CPC ..... *G03G 15/2039* (2013.01); *G03G 15/5087* (2013.01)

(58) Field of Classification Search
CPC .. G03G 13/20; G03G 15/2039; G03G 15/205; G03G 15/5087
See application file for complete search history.

(56) References Cited

U.S. PATENT DOCUMENTS

| | | | | |
|---|---|---|---|---|
| 5,189,528 | A | 2/1993 | Takashima et al. | |
| 6,393,233 | B1 | 5/2002 | Soulier | |
| 7,356,275 | B2 | 4/2008 | Baruch et al. | |
| 7,869,730 | B2 | 1/2011 | Cho | |
| 8,178,209 | B2 | 5/2012 | Qi et al. | |
| 9,037,026 | B2 | 5/2015 | Kurokawa | |
| 9,342,000 | B2 | 5/2016 | Sugiyama | |
| 2009/0208235 | A1 | 8/2009 | Yoon | |
| 2013/0136479 | A1* | 5/2013 | Yuasa | G03G 15/36 399/69 |
| 2014/0160526 | A1 | 6/2014 | Shinagawa | |

OTHER PUBLICATIONS

Samsung ~ Increase Producivity and Simplicity at the Same Time, 24-Aor-2011, http://www.samsung.com/us/ ~ 6 pages.

* cited by examiner

*Primary Examiner* — Hoang X Ngo
(74) *Attorney, Agent, or Firm* — Brooks Cameron & Huebsch PLLC

(57) ABSTRACT

Example implementations relate to first page out reduction. For example, a system according to the present disclosure may include a host computing device including a processor. The system may further include a printer coupled to the host computing device. The processor may determine a distribution of print content relative to a leading edge of a page of print medium. The processor may further determine a first threshold fuser temperature in response to the determination of the distribution of print content.

12 Claims, 3 Drawing Sheets

FIRST PAGE OUT REDUCTION

BACKGROUND

A printing device may include a fuser component. When a print command is received, the fuser may heat up in order to fuse toner to the page of print medium and print the desired content. The length of time for the fuser to heat to allow fusing to occur may increase the amount of time that elapses before the first page of content is printed.

DETAILED DESCRIPTION

Many printers include a fuser to fuse toner onto a page of print media in order to print content onto the page. When a print command is received, the fuser may preheat before printing is able to begin in order for fusing of toner to occur. Some printers use a default fuser temperature, requiring the fuser to heat to the default temperature each time the printer is to be used. The preheating of the fuser may take a certain amount of time, during which printing may not initiate. This preheating time may delay the beginning of printing and thus increase the amount of time that will elapse before the first page of content is printed First page out reduction according to the present disclosure may allow a first page of print content to be printed more quickly. This may be accomplished by reducing the temperature to which the fuser is preheated and thus reduce the amount of time spent preheating. In some embodiments, the fuser temperature may be reduced due to an analysis that the amount and/or type of content to be printed on the first page of print medium may use a lower temperature while still achieving fusing of the toner. Additionally, the fuser temperature may be reduced based on the distribution of the print content.

When first page out reduction is used according to the present disclosure, the amount of time between a print command being sent and the first page of content being printed may be reduced. Put another way, the first page of content may be printed more quickly due to the reduced temperature of the fuser and thus the reduced amount of time spent preheating the fuser.

Figure 1:
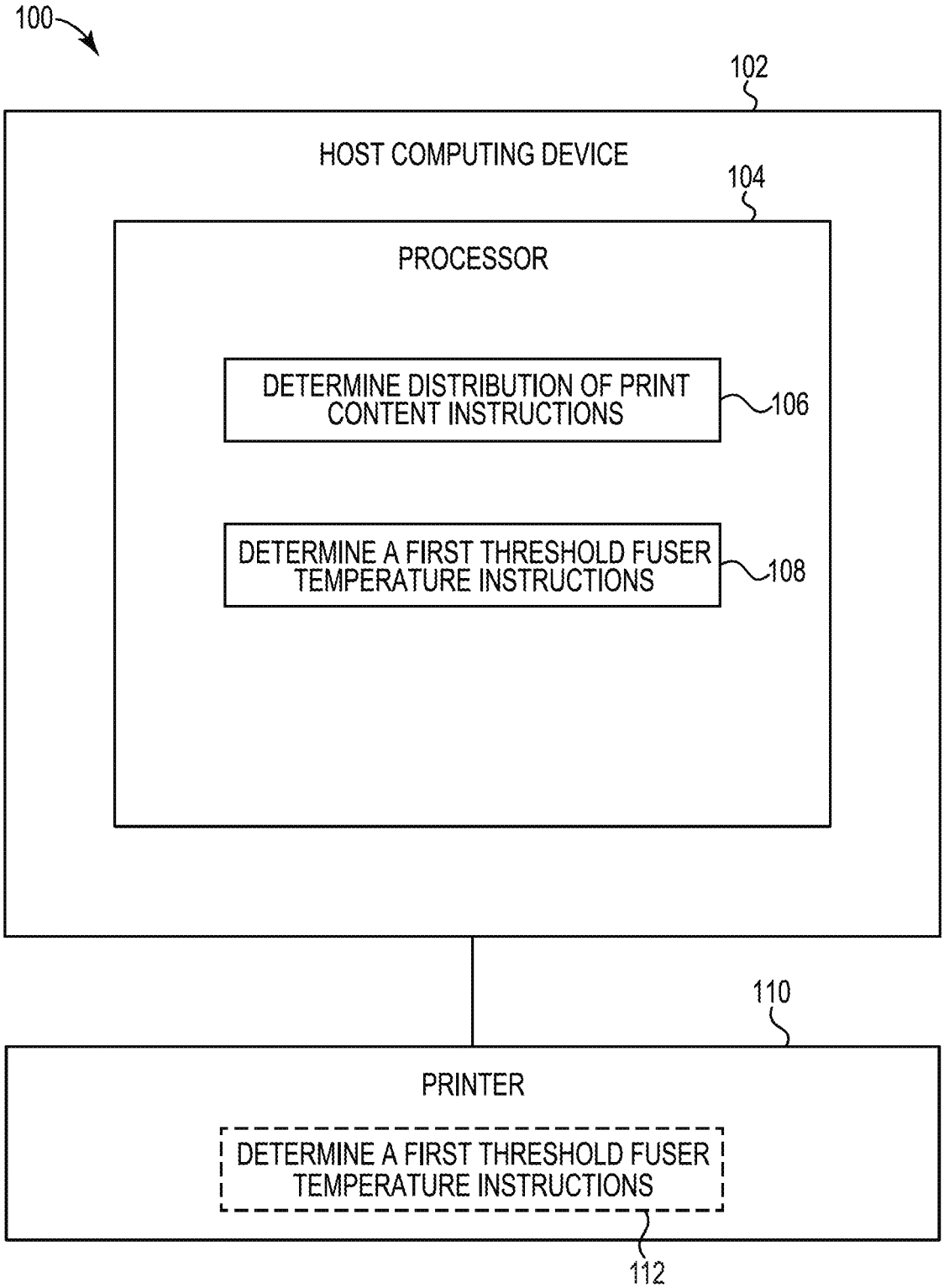
FIG. 1 is a diagram of an example system for first page out reduction, according to the present disclosure.

FIG. 1 illustrates an example system 100 for first page out reduction according to the present disclosure. As illustrated in FIG. 1, system 100 may include multiple components. For example, system 100 may include a host computing device 102. The host computing device 102 may include a processor 104. Processor 104 may be a central processing unit (CPU), a semiconductor based microprocessor, and/or other hardware devices suitable for retrieval and execution of instructions.

System 100 may further include a printer 110. Printer 110 may be a laser printer, although examples are not so limited and other varieties of printers may be used. As shown in FIG. 1, printer 110 may be coupled to host computing device 102. Printer 110 may be coupled to host computing device 102 via a wired connection or via a wireless connection.

Printer 110 may include various components. For example, printer 110 may include a fuser. As used herein, a fuser refers to a component within the printer that fuses toner onto a page of print medium. Upon initiation of a print job, the fuser may preheat to a threshold temperature. The threshold temperature may be the temperature at which toner will fuse onto the page of print medium.

Printer 110 may further include a processor. The processor may execute instructions such as instructions 112. The processor may further determine the threshold temperature for the fuser.

Printer 110 may further include a formatter. As used herein, a formatter refers to a component that receives an image of content to be printed and coordinates the timing for printing the content onto a page of print medium. For example, a formatter may instruct the fuser to begin fusing toner at a particular location on the page of print medium. The formatter may determine where on a page of print medium content is to be printed by counting scan lines. As used herein, a scan line refers to a single pass of a laser in a laser printer, such as printer 106. A single scan line may take a defined amount of time and cover a defined width of the page of print medium. The formatter may determine the number of scan lines necessary to reach the beginning of the print content from the image of the content and then count the number of scan lines to determine when to instruct the fuser to being fusing toner to the page of print medium.

Processor 104 may retrieve and execute instructions such as instructions 106 and 108. When executed by processor 104, determine a distribution of print content instructions 106 may cause processor 104 to analyze a page of print content and determine the distribution of the print content relative to a leading edge of a page of print medium. As used herein, print content refers to the words and/or images that are to be printed onto a page of print medium. As used herein, a leading edge of a page of print medium refers to the edge of the page of print medium that leads through the printer. The leading edge may correspond to the top of the page. Determine a distribution of print content instructions 106 may instruct processor 104 to analyze the entire page of print content relative to the leading edge or they may instruct processor 104 to only analyze a portion of the page of print content relative to the leading edge.

Determine a first threshold fuser temperature instructions 108, when executed by processor 104, may cause processor 104 to determine a threshold fuser temperature necessary to print the analyzed print content. The first threshold fuser temperature determined at 108 may be lower than the default fuser temperature. In some instances, determine a first threshold fuser temperature instructions 108, when executed by processor 104, may correspond to a first threshold fuser temperature necessary to print a portion of the page of print content.

In some embodiments, the determination of the first threshold fuser temperature may occur on the printer 110. In such cases, determine a first threshold fuser temperature instructions 112 may be executed by the processor located on printer 110. Determine a first threshold fuser temperature instructions 112 may cause the processor located on the printer to determine a threshold fuser temperature necessary to print the analyzed content.

In some embodiments, processor 104 may further include instructions to determine a second threshold fuser temperature. The second threshold fuser temperature may be higher or may be lower than the first threshold fuser temperature. The second threshold fuser temperature may correspond to a second fuser temperature necessary to print a portion of print content analyzed at 106. In some embodiments, where determine distribution of print content instructions 106 have caused processor 104 to analyze the full page of print content, the second threshold fusion temperature may correspond to a temperature necessary to print content located further from the leading edge. In some embodiments, processor 104 may dynamically adjust the fuser temperature based on the determined first and second threshold fuser temperatures. As used herein, to dynamically adjust a fuser temperature refers to changing the temperature of the fuser over time. In some instances, the fuser temperature may be changed during the course of the print job, such that the fuser temperature at the beginning of the print job is different from the fuser temperature at the end of the print job.

Processor 104 may further transmit instructions to printer 110 and its components. For example, processor 104 may transmit a Top of Page (/TOP) instruction to the formatter located on printer 110. The /TOP instruction may instruct the formatter to begin counting scan lines in order to determine where printing is to begin. Processor 104 may also distribute the first and second threshold fuser temperatures to printer 110.

Figure 2:
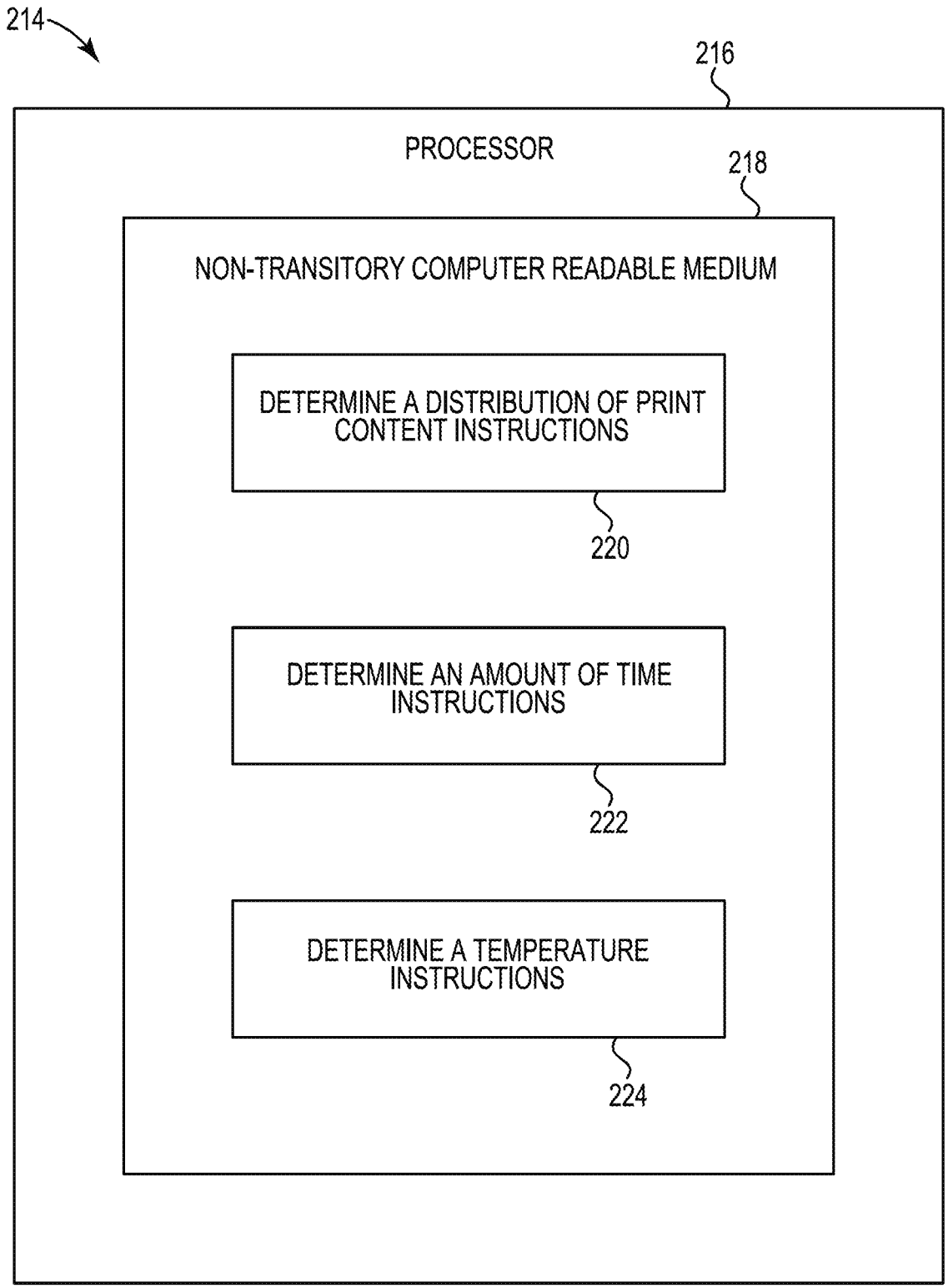
FIG. 2 is a block diagram of an example system for first page out reduction, according to the present disclosure.

FIG. 2 illustrates an example system 214 for first page out reduction according to the present disclosure. System 214 may include a variety of components, as illustrated in FIG. 2. For example, system 214 may include a processor 216 and a non-transitory computer readable medium 218. Although the following descriptions refer to a single processor and a single machine-readable storage medium, the descriptions may also apply to a system with multiple processors and multiple machine-readable storage mediums. In such examples, the instructions may be distributed (e.g., stored) across multiple machine-readable storage mediums and the instructions may be distributed (e.g., executed by) across multiple processors. Said differently, although only a single processor 216 is shown, multiple processors may work in conjunction with processor 216 to execute the instructions Processor 216 may be a central processing unit (CPU), a semiconductor based microprocessor, and/or other hardware devices suitable for retrieval and execution of instructions stored in computer-readable storage medium 218. Processor 216 may fetch, decode, and execute instructions 220, 222, 224, or a combination thereof. As an alternative or in addition to retrieving and executing instructions, processor 216 may include at least one electronic circuit that includes electronic components for performing the functionality of instructions 220, 222, 224, or a combination thereof. Processor 216 may be akin to processor 104 of system 100.

Machine-readable storage medium 218 may be any electronic, magnetic, optical, or other physical storage device that stores executable instructions. Thus, machine-readable storage medium 218 may be, for example, Random Access Memory (RAM), an Electrically-Erasable Programmable Read-Only Memory (EEPROM), a storage drive, an optical disc, and the like. Machine-readable storage medium 218 may be disposed within system 214, as shown in FIG. 2. In this situation, the executable instructions may be "installed" on the system 214. Additionally and/or alternatively, machine-readable storage medium 218 may be a portable, external or remote storage medium, for example, that allows system 214 to download the instructions from the portable/external/remote storage medium. In this situation, the executable instructions may be part of an "installation package". As described herein, machine-readable storage medium 218 may be encoded with executable instructions for monitoring network utilization.

Referring to FIG. 2, determine distribution instructions 220, when executed by a processor such as processor 216, may cause system 214 to determine a distribution of print content to be printed. Determine distribution instructions 220 may cause system 214 to determine the distribution of print content relative to a leading edge of a page of print medium. Determine distribution instructions 220 may include instructions to determine an amount of content to be printed. Determine distribution instructions 220 may further include instructions to determine a distribution of content to be printed. For example, determine distribution instructions 220 may include instructions to determine the location on the page of print content with the most amount of content to be printed. This may be done by first determining the print content in a plurality of locations on the page. Then, a determination may be made as to which location contains a greatest amount, or greatest density, of print content. In other words, determine distribution instructions 220 may determine which areas on a page of print content has the most amount of toner to be fused to the page, relative to the rest of the page.

Determine an amount of time instructions 222, when executed by a processor such as processor 216, may cause system 214 to determine an amount of time to elapse before a page of print medium will enter a fuser, such as the fuser on printer 110 in FIG. 1. Determine an amount of time instructions 222 may include instructions to determine a number of scan lines to occur between a top of a page of print medium and the beginning of the print content. As discussed previously, a single scan line may take a defined amount of time and cover a defined amount of space. Thus, determine an amount of time instructions 222 may cause system 214 to determine a number of scan lines to occur prior to reaching the print content. Determine an amount of time instructions 222 may further include instructions to cause system 214 to count the number of scan lines as the page of print medium advances through a printer.

Determine temperature instructions 224, when executed by a processor such as processor 216, may cause system 214 to determine a fuser temperature for printing. The determined fuser temperature may correspond to the distribution of print content determined at 220. For example, a lower fuser temperature may be used when the print content distribution is sparse, whereas a higher fuser temperature may be used for a dense print content distribution. As used herein, a sparse print content distribution refers to a print content distribution below a threshold distribution. As used herein, a dense print content distribution refers to a print content distribution above a threshold distribution. Further, determine temperature instructions 224 may use the amount of time determined at 222 to determine the fuser temperature. In some examples, when the amount of time determined at 222 is longer, determine temperature instructions 224 may determine that the fuser has a longer period of time to heat up. By contrast, in some examples, when the amount of time determined at 222 is shorter, determine temperature instructions 224 may determine that the fuser is to heat to the determined temperature in a shorter period of time.

Machine readable storage medium 218 may further include instructions that, when executed by a processor such as processor 216, cause system 214 to dynamically adjust the fuser temperature based on the distribution of print content determined at 220. In other words, system 214 may adjust the temperature of the fuser based on the content to be printed throughout the page of print content. For example, determine distribution of print content instructions 220 may cause system 214 to determine that the print content is heavily concentrated towards the middle of a page of print medium. Determine amount of time instructions 222 may cause system 214 to determine that it will take a first amount of time, t1, to reach the beginning of the print content and a second amount of time, t2, to reach the heavily concentrated portion of the print content. Determine temperature instructions 224 may then cause system 214 to determine that a first fuser temperature is to be used to print the beginning of the print content and a second fuser temperature is to be used to print the middle of the print content. System 214 may then dynamically adjust the fuser temperature such that the fuser temperature corresponds to the portion of the print content being printed.

Machine readable storage medium 218 may further include instructions that, when executed by a processor such as processor 216, cause system 214 to transmit a /TOP signal. The /TOP signal may include instructions to begin advancing a page of print medium through a printer, such as printer 110 shown in FIG. 1.

Figure 3:
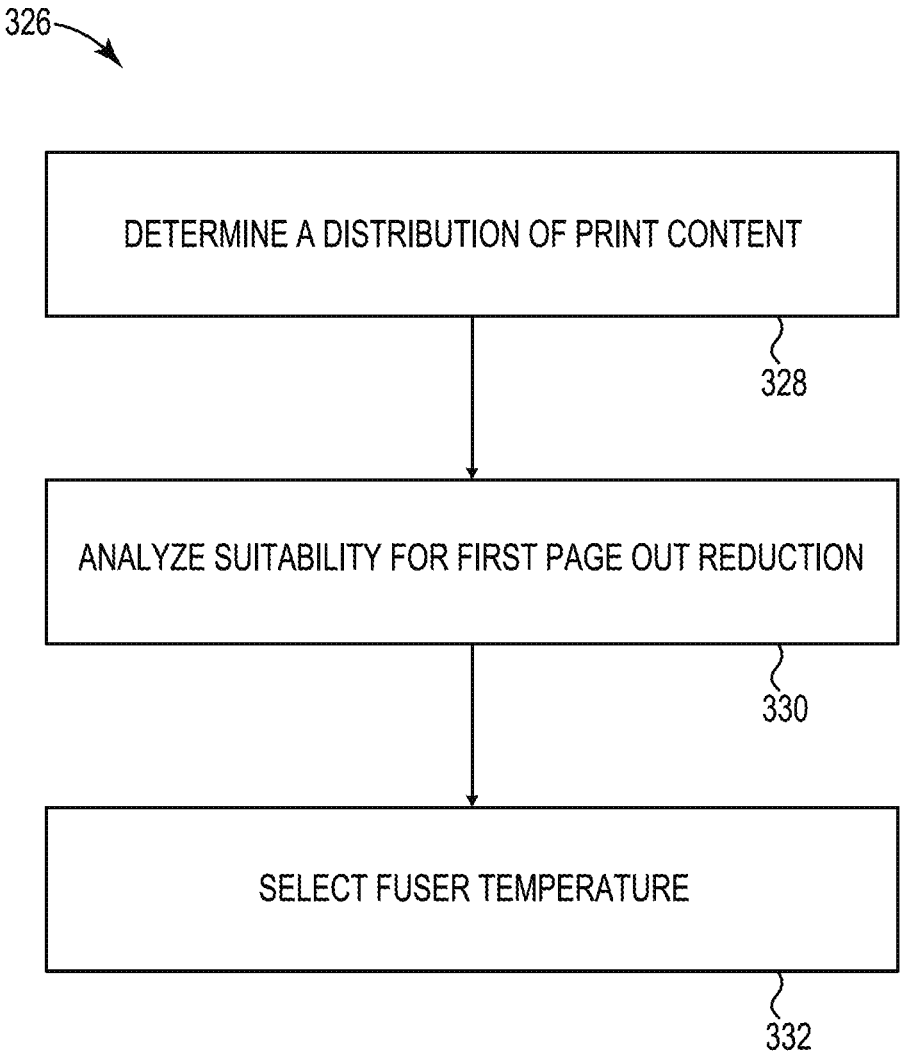
FIG. 3 illustrates an example method for first page out reduction, according to the present disclosure.

FIG. 3 illustrates an example method 326 for first page out reduction according to the present disclosure. At 328, a distribution of print content is determined. The distribution of print content may be determined relative to the leading edge of the page of print medium. The distribution of print content may further be determined for a full page of print content or may be determined for only a portion of a page of print content.

At 330, suitability for first page out reduction is analyzed. As used herein, suitability for first page out reduction refers to the determination that the use of first page out reduction is appropriate for a first page of print content. Analysis for first page out reduction suitability may include for example, analysis of the distribution of print content and analysis of the amount of toner to be fused onto the page of print medium. Analysis for first page out reduction suitability may further include analysis of the status of a printer to be used. For example, a printer that has been in use will have a fuser that has already been heated. By contrast, a printer that has not been in use may have its fuser preheat before being able to print. When a fuser is to preheat, first page out reduction may be utilized to reduce the amount of time for heating.

At 332, fuser temperature is selected. The fuser temperature selected may depend on the distribution of print content determined at 328 and on the suitability for first page out reduction analyzed at 330. For example, if first page out reduction is determined to be suitable, the fuser temperature selected at 332 may be a reduced fuser temperature. If first page out reduction was not determined to be appropriate at 330, a default fuser temperature may be selected at 332.

Method 326 may further include attaching a first page out reduction tag to a print job in response to a determination that a job is suitable for first page out reduction at 330. As used herein, a first page out reduction tag refers to an instruction tag transmitted with a print job to signal to the printer that first page out reduction is appropriate. In some examples, the first page out reduction tag may be attached by a host, such that the host may instruct a remotely connected printing device. In other examples, the first page out reduction tag may be attached by the printer. Upon receipt of a print job tagged with a first page out reduction, a printer will use first page out reduction.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to one or more of such elements and/or features.

What is claimed:

1. A system, comprising:

a host computing device including a processor, the processor to:

determine a distribution of print content relative to a leading edge of a page of print medium;

in response to the determination of the distribution of print content, determine a first threshold fuser temperature;

send an image of the print content to a formatter located on a printer;

determine a location at which print content begins relative to the leading edge of the page of print medium; and the printer coupled to the host computing device.

2. The system of claim 1, the processor to further:

transmit a top of page (/TOP) signal to the formatter, wherein the/TOP signal instructs the formatter to begin counting scan lines.

3. The system of claim 2, the formatter to:

count a threshold number of scan lines; and in response to counting the threshold number of scan lines, instruct a fuser located on the printer to fuse the print content to the page of print media.

4. The system of claim 1, further comprising the processor to:

determine the distribution of print content for the page of print medium;

determine a second threshold fuser temperature to print each of a plurality of sections of the page of print media; and transmit the second threshold temperature for each of the plurality of sections to a fuser located on the printer.

5. The system of claim 4, further comprising the processor to dynamically adjust a temperature of the fuser based on the second threshold temperature.

6. A non-transitory computer readable medium containing instructions executable by a processor to:

determine a distribution of print content relative to a leading edge of a page of print medium;

determine an amount of time to elapse before the page of print medium will enter a fuser;

determine a number of scan lines to occur to reach the print content, wherein each scan line takes a defined amount of time;

count the number of scan lines, wherein counting the number of scan lines takes the defined amount of time; and determine a temperature for the fuser, based on the determined amount of time and the determined distribution of print content.

7. The non-transitory computer readable medium of claim 6, further comprising instructions executable to:

analyze the print content of the page of print medium;

determine the temperature for the fuser based on the analyzed print content; and dynamically adjust a temperature of the fuser based on the determination of the temperature.

8. The non-transitory computer readable medium of claim 6, further comprising instructions executable to:

send a top of page (/TOP) signal, wherein the/TOP signal includes instructions to advance the page of print medium through a printer.

9. A method, comprising:

determining, by a processor located on a printer, a distribution of print content relative to a leading edge of a page of print medium;

analyzing, by the processor, a print job for suitability of first page out reduction, based on the distribution of print content;

determining an amount of content to be printed;

determining a location of the content to be printed relative to the leading edge of the page of print media; and selecting, by the processor, a fuser temperature for the print job, based on the distribution of print content and the analysis of the suitability for first page out reduction.

10. The method of claim 9, further comprising selecting a default temperature for the fuser in response to a determination that the print job is not suitable for first page out reduction.

11. The method of claim 9, further comprising selecting a reduced temperature for the fuser in response to a determination that the print job is suitable for first page out reduction.

12. The method of claim 9, further comprising:

in response to determining that the print job is suitable for first page out reduction, attaching a first page out reduction tag to the print job; and executing first page out reduction in response to attachment of the first page out reduction tag.

* * * * *